United States Patent [19]

Friedman

[11] Patent Number: 4,622,769

[45] Date of Patent: Nov. 18, 1986

[54] COLLAPSIBLE DIE-CUT PICTURE FRAME

[76] Inventor: Arthur S. Friedman, 2144 Seneca Dr. W., Merrick, N.Y. 11566

[21] Appl. No.: 772,698

[22] Filed: Sep. 5, 1985

[51] Int. Cl.[4] ..... A47G 1/06; G09F 1/12

[52] U.S. Cl. ..... 40/152.1; 40/10 R; 40/16.2; 40/152; 40/154; 40/159

[58] Field of Search ..... 40/152.1, 152, 154, 40/155, 156, 158 R, 158 B, 159, 539, 538, 10 R, 16.2, 16.4

[56] References Cited

U.S. PATENT DOCUMENTS

| | | | |
|---|---|---|---|
| 2,112,583 | 3/1938 | Tucker et al. | 40/152.1 |
| 2,419,823 | 4/1947 | Cross et al. | 40/154 |
| 2,428,772 | 10/1947 | Aranoff | 40/152 |
| 2,443,234 | 6/1948 | Ford, Jr. | 40/152.1 |
| 2,453,902 | 11/1948 | Graham | 40/152.1 |
| 2,480,918 | 9/1949 | Goldman | 40/152.1 |
| 2,805,504 | 9/1957 | Stein | 40/152.1 |
| 2,961,789 | 11/1960 | Hughes | 40/152 |
| 2,968,108 | 1/1961 | Knox | 40/152 |
| 3,041,761 | 7/1962 | Knox | 40/152 |
| 3,041,762 | 7/1962 | Knox | 40/152 |
| 3,234,676 | 2/1966 | Colicki et al. | 40/152.1 |

FOREIGN PATENT DOCUMENTS

| | | | |
|---|---|---|---|
| 1249386 | 11/1960 | France | 40/152.1 |
| 1299010 | 2/1963 | France | 40/606 |
| 3071 | of 1891 | United Kingdom | 40/152 |

*Primary Examiner*—Gene Mancene
*Assistant Examiner*—J. Hakomaki
*Attorney, Agent, or Firm*—Dennison, Meserole Pollack & Scheiner

[57] ABSTRACT

An inexpensive collapsible picture frame is formed from a single blank of cardboard and includes two adjacent panels, one of which has a cut-out window between which a picture may be inserted; the other of these panels having a lock slot cut therein and a glue tab assembly. A support panel having tapered sides is folded rearwardly from one edge of the panel having the cut-out window to permit the frame to be oriented on a surface in either a horizontal or vertical viewing format, and an easel brace panel folds from the end of the support panel toward the two adjacent panels and has a lock tongue engageable in the lock slot to retain the frame in assembled condition wherein the two adjacent picture receiving panels are bowed into a convex shape to aid in frictionally retaining the picture and to reduce glare in use.

8 Claims, 10 Drawing Figures

COLLAPSIBLE DIE-CUT PICTURE FRAME

BACKGROUND OF THE INVENTION

The present invention relates generally to small inexpensive self-standing frames for photographs, and specifically to a one piece cardboard die-cut frame which may be collapsed to a very thin flat configuration such that, for example, it could be packaged with film or other products as a premium or give-away, and yet may be easily erected for display on a desk or the like.

Prior art cardboard frames which are collapsible have been used in the past, but have not been commercially successful for two principal reasons. Many had multiple parts or required extensive gluing of flaps in a somewhat complex assembly operation, whereas others were flimsy in construction and either would not withstand more than minimal handling in use or would not securely retain a picture therein, so that when shifted, the picture would easily slip out. Further, most such frames were usable in only one position such that they had to either be made for a square picture, or for vertical or horizontal positioning.

SUMMARY OF THE INVENTION

My present invention provides a very inexpensive, easily erected die-cut picture frame for displaying and protecting photographs and which is formed from a single blank of cardboard. In its stored non-use position, the frame is extremely thin and compact, such that it could easily be packaged with film such as the types which are developed within the camera.

The frame can be easily erected by the user by merely pulling up on a single flap so that an easel brace panel will lock into place automatically and will also serve to slightly bow the frame for the purpose of frictionally retaining the picture therewithin and secondarily to reduce light glare reflection from a shiny photographic surface when displayed on a desk or table.

The blank from which the picture frame is constructed consists of four panels, an intermediate frame border panel, an intermediate rear support panel, an end easel brace panel and locking tongue, and an end frame back and lock panel having an integral brace tongue. When assembled, a tab on the brace tongue is glued to an intermediate portion of the easel brace panel. Thereafter erection of the frame takes place upon minor flexure of the panels.

OBJECTS OF THE INVENTION

A principal object of the invention is the provision of an inexpensive cardboard picture frame which is simple in construction and easy to erect.

A further object is to provide a die-cut picture frame which is extremely thin and flat when folded and which when erected will hold a photograph in one of several orientations for display.

An object of the invention is the provision of a flexible die-cut picture frame, which when erected causes a slight bow or flexure of the picture and frame to prevent slippage of the picture out of the frame and to reduce problems of light glare in use.

A still further object is to provide a collapsible inexpensive picture frame which is small and sufficiently compact to be packaged as a premium in a box of instant developing film.

Other objects and advantages of my invention will be apparent from the following detailed description thereof taken in conjunction with the accompanying drawings wherein a preferred form and a modification thereof are depicted.

DESCRIPTION OF THE DRAWINGS

In the accompanying drawings wherein like reference characters refer to the same or similar elements.

DETAILED DESCRIPTION OF THE PREFERRED EMBODIMENT

With specific reference to the drawings, the frame is shown generally at 10 and is constructed from a die-cut blank 11 preferably formed of smooth surface cardboard or boxboard. The blank is generally rectangular in shape and is creased or scored vertically at three places between the ends at 12, 13 and 14 to define four panels. Panel 15 is the intermediate frame border panel and has a cut-out window 16 therein. While the window area is shown as horizontal and rectangular in the blank 11 it could be cut in any desired shape. Panel 17 is formed on one end of blank 11 and serves as the back of the frame. When folded along line 12 it defines the picture-receiving area with panel 15.

Figure 6:
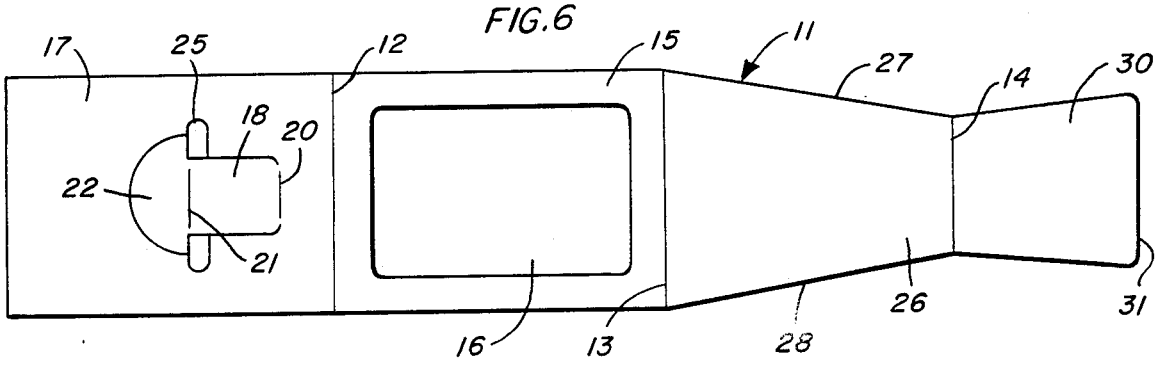
FIG. 6 is a plan view of the die-cut blank from which the frame of the invention is formed.

It will be seen from FIG. 6 that a round headed T flap 18 is die cut on all but one side in panel 17. A score or crease line 20 allows the flap 18 to pivot or fold and an intermediate score 21 is also shown. The portion of the flap to the left of score line 21 in FIG. 6 defines glue tab 22 whereas the rectangular portion 23 between lines 20 and 21 defines a rigidifying locking tongue support as will be described further herein.

An elongated lock slot 25 is also cut out of the blank 17 as later described to receive a lock tongue for the purpose of maintaining the frame in its erected position.

Intermediate rear support panel 26 defined between score lines 13 and 14 has converging sides 27 and 28 and is in the shape of a trapezoid. It is this shape which permits the frame to be oriented in use either vertically or horizontally, depending on the orientation of the picture to be displayed.

The end panel 30 serves as the easel brace panel to brace and support panel 26 and has an end lock tongue 31 which engages within the lock slot 25. It will be seen from FIG. 8 that glue tab 22 is adhesively secured to one face of the panel 30.

Figure 1:
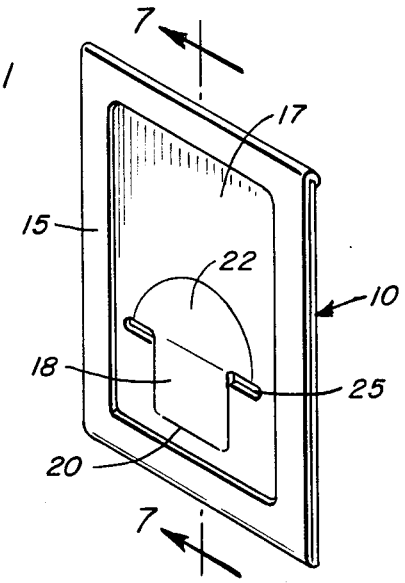
FIG. 1 is a front top perspective view of my invention in its assembled but collapsed condition.
Figure 2:
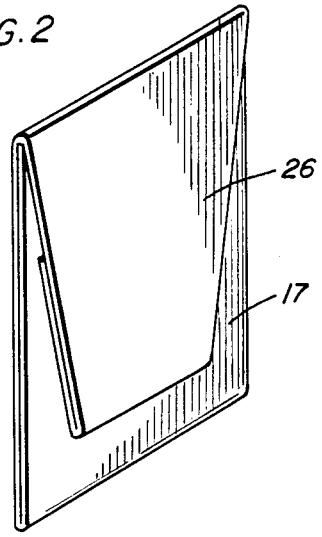
FIG. 2 is a top rear perspective similar to FIG. 1.

During manufacture, after die-cutting, panels 17 and 30 are folded inwardly along crease lines 12 and 14 and then panel 26 with its now overlying panel 30 is folded inwardly along line 13. Thereafter, adhesive is applied to the glue tab 22 so as to adhere to the panel 30. The complete collapsed panel appears as in FIGS. 1 and 2. It will be noted that due to the extremely thin shape of the collapsed picture frame, it lends itself well to packaging within a box of film such as the film sold with "instant" cameras, so that a frame is available immediately after development of the picture for display and protection thereof. The compact, thin shape also permits carrying in a pocket.

Figure 3:
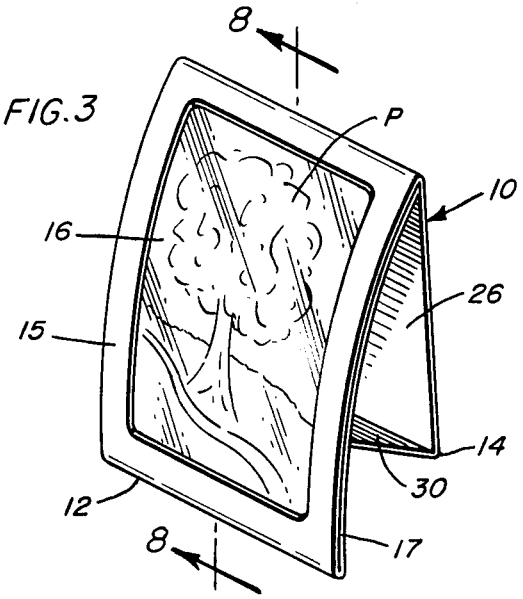
FIG. 3 is a top front perspective of the frame of the invention in its erected, use condition with a picture therein.
Figure 4:
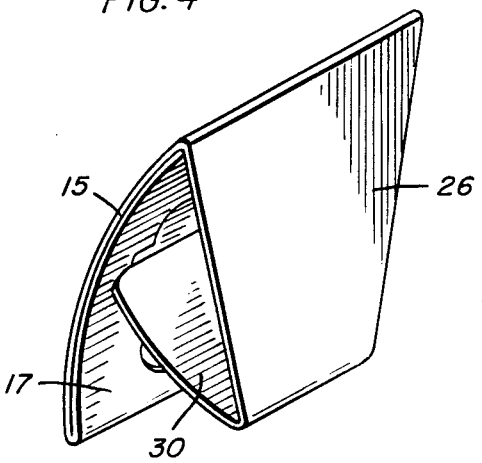
FIG. 4 is a top rear perspective of the erected frame.

In order to use the frame a picture as shown at P in FIG. 3 is inserted from the side, between the frame border panel 15 and the frame back panel 17. In the planar condition of the frame, the inserted picture is relatively loose and can easily slip out of the frame.

Figure 7:
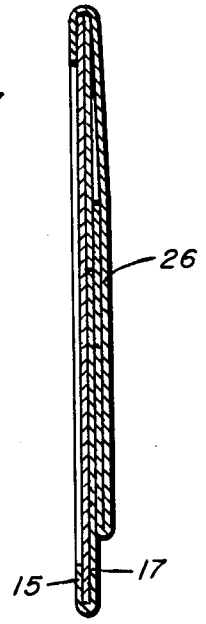
FIG. 7 is a cross-sectional view taken along line 7—7 of FIG. 1.
Figure 8:
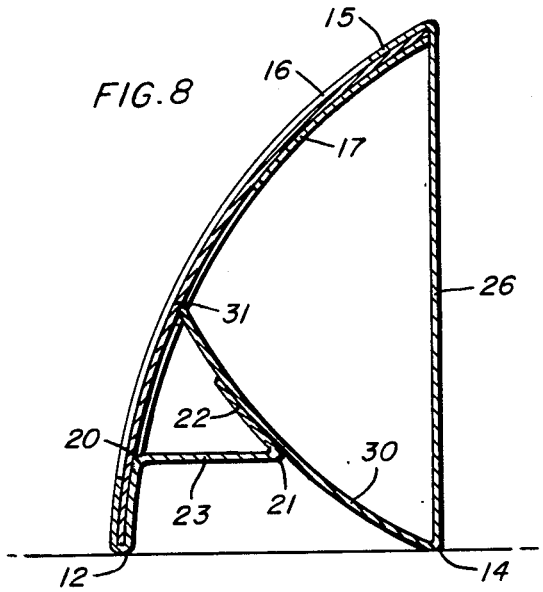
FIG. 8 is a cross-sectional view taken along line 8—8 of FIG. 3.
Figure 10:
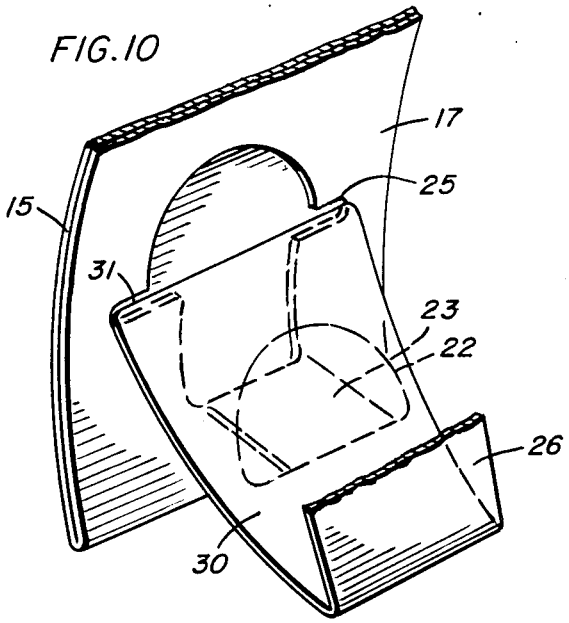

When it is desired to erect the frame for use, the support panel is moved to the right (FIG. 7) about the crease line 13 and the easel brace panel 30 is swung downwardly about crease line 14 until the lock tongue 31 falls into place in the lock slot 25 as best shown in FIGS. 8 and 10. This results in a slight bowing of the frame border panel 15 and frame back panel 17. This bowing action frictionally locks the picture P within the frame and obviates any tendency of the picture to slip out of the frame side openings.

Figure 5:
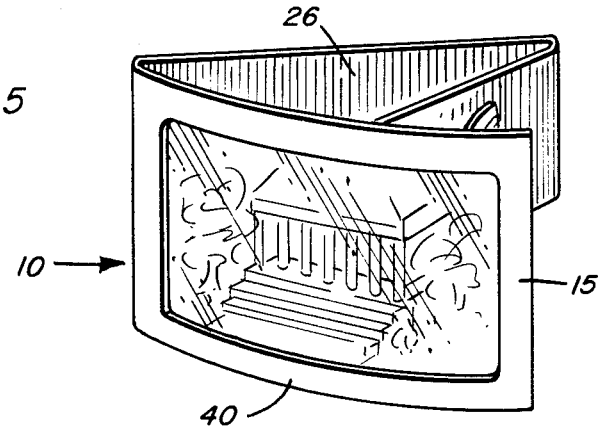
FIG. 5 is a top front perspective of the erected frame in its horizontal or landscape format viewing position.

The erected frame can be placed on a desk or shelf resting on crease line 14 and line 12. As seen in FIG. 3, this preferably is the vertical, or "portrait" presentation. Alternatively, if the picture format is horizontal or "landscape" the frame may be rested on one of the side edges 40, as shown in FIG. 5, and the angled side 28 of the trapezoidal rear support panel 26. Due to the angle of the edge or side 28, the frame will be tipped rearwardly at an angle similar to that of FIGS. 3 and 8.

Figure 9:
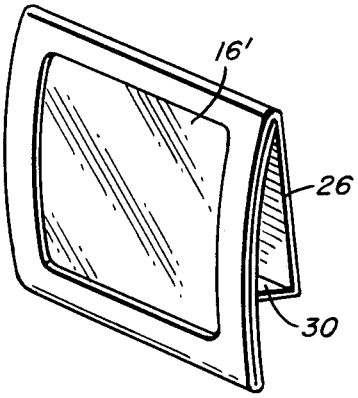
FIG. 9 is a perspective view similar to FIG. 3 but showing a first modified form of the invention; and, FIG. 10 is an enlarged rear perspective similar to FIG. 4, but showing some parts broken away and others in phantom.

As shown in FIG. 9, the cut-out window 16' may be made square, or even circular if desired (not shown). It is also contemplated that portions of the frame may be colored or imprinted with advertising indicia or decorative designs if desired.

It will be appreciated that after erection the frame may be repeatedly collapsed and opened and the picture changed from time to time as desired.

It is understood that while certain embodiments of the present invention have been illustrated and described herein, it is not to be limited to the specific forms or arrangements of the parts shown and described.

I claim:

1. A collapsible one piece picture frame assembly which is covexly bowed in use consisting of a single cardboard blank scored along three parallel lines to provide four panels, one end panel and the immediately adjacent panel comprising, when folded in juxtaposition, the frame between which a picture may be inserted, said one end panel having die cut therefrom a lock slot, a rigidifying locking tongue support and glue tab means on the end thereof, said immediately adjacent panel having a die-cut picture-viewing window therein, said other end panel serving as an easel brace and having its free end defining a lock tongue adapted to engage within said lock slot to hold said frame in its erected position, said glue tab means adapted to be secured to a face of said easel brace, said remaining panel serving when the frame assembly is erected as a support for the frame.

2. A collapsible picture frame assembly as defined in claim 1, wherein said remaining panel serving as a support has side edges tapering inwardly from the score line common with said immediately adjacent panel toward said score line common with said easel brace panel, whereby said frame assembly may rest on the score line fold between said easel brace panel and said remaining panel, or alternatively on one of said tapered side edges, to allow both a vertical and a horizontal viewing format.

3. A collapsible picture frame assembly as defined in claim 2, wherein said frame within which the picture is received is bowed into a convex shape when the frame assembly is erected.

4. A collapsible picture frame assembly as defined in claim 1, wherein said picture-viewing window is rectangular.

5. A collapsible picture frame assembly as defined in claim 4, wherein said picture-viewing window is square.

6. A collapsible picture frame assembly formed from flexible cardboard, which frame is substantially rigid in use, said frame assembly comprising a front picture receiving pocket which is convexly bowed in use to assist in frictionally holding a picture therein and having a picture viewing window on one side and a lock slot on the other, a rearwardly folded support panel upon which the assembly rests when erected, an easel brace extending from the support panel toward said pocket and having a lock tongue on the end thereof adapted to be received within said lock slot to maintain the assembly in its erected state, and a locking tongue support integral with said pocket and secured to said easel brace intermediate its ends to assist in rigidifying the assembly when erected.

7. A collapsible picture frame assembly as defined in claim 6, wherein the entire assembly is formed from a single blank of material.

8. A collapsible frame assembly as defined in claim 6, wherein said rearwardly folded support panel tapers in width from its area of joinder with the picture receiving pocket to its other end.

* * * * *